United States Patent [19]

Nowell et al.

[11] Patent Number: 4,885,659

[45] Date of Patent: Dec. 5, 1989

[54] STATIC DISSIPATIVE MAT

[75] Inventors: Gilbert S. Nowell, Marietta; Frederick D. Tenzer, Kennesaw, both of Ga.

[73] Assignee: Pandel, Inc., Cartersville, Ga.

[21] Appl. No.: 136,101

[22] Filed: Dec. 21, 1987

[51] Int. Cl.[4] ..... H05F 3/00

[52] U.S. Cl. ..... 361/212; 361/216; 361/220; 428/49; 428/284; 428/285; 428/432; 428/457

[58] Field of Search ..... 428/263, 284, 273, 268, 428/49, 285, 432, 457; 361/212, 216, 220

[56] References Cited

U.S. PATENT DOCUMENTS

| | | | |
|---|---|---|---|
| 4,208,696 | 6/1980 | Lindsay et al. | 361/212 |
| 4,312,913 | 1/1982 | Rheaume | 428/263 |
| 4,363,071 | 12/1982 | Rzepecki et al. | 361/220 |
| 4,435,465 | 3/1984 | Ebneth et al. | 428/263 |
| 4,459,334 | 7/1984 | Blanpied et al. | 428/285 |
| 4,464,432 | 8/1984 | Dost et al. | 428/285 |
| 4,472,471 | 9/1984 | Klein et al. | 428/247 |
| 4,478,771 | 10/1984 | Schreiber | 428/285 |
| 4,486,490 | 12/1984 | Patz et al. | 428/273 |
| 4,500,591 | 2/1985 | Peltier et al. | 428/285 |
| 4,508,776 | 4/1985 | Smith | 428/263 |
| 4,590,120 | 5/1986 | Klein | 428/247 |
| 4,657,807 | 4/1987 | Fuerstman | 428/263 |
| 4,710,415 | 12/1987 | Slosberg et al. | 428/48 |

FOREIGN PATENT DOCUMENTS 6506823 11/1966 Netherlands .

*Primary Examiner*—James J. Bell
*Attorney, Agent, or Firm*—Richard P. Crowley

[57] ABSTRACT

A static dissipative surface covering material which comprises a thermoplastic polymer layer and an electrically conductive, metallized, such as vacuum aluminum-coated, glass fiber tissue material disposed in or to the thermoplastic layer to provide a static dissipative surface covering material. A method of preparing a static dissipative surface covering material, which method comprises embedding within or securing to a thermoplastic polymer layer a layer of electrically-conductive, metallized, coated, open fibrous material, such as an aluminized glass fiber tissue, to provide a static dissipative surface covering material.

15 Claims, 1 Drawing Sheet

STATIC DISSIPATIVE MAT

BACKGROUND OF THE INVENTION

Plastic mats or runners are commonly employed to provide cushioning and shock-absorbing covering surfaces for objects or people. In particular, vinyl chloride plastic mats and runners composed of a vinyl chloride foam or solid layers, or combinations thereof, are often used as flexible surface coverings. Such plastic mats are often manufactured employing one or more reinforcing layers in order to impart dimensional stability to the plastic mat, such as, for example, the employment of fibrous sheet materials, such as nylon, polyester or glass fiber scrim tissue sheet material embedded within the thermoplastic layer which makes up the plastic mat (see U.S. Pat. No. 4,710,415, issued Dec. 1, 1987).

Plastic mats or runners are often employed in areas containing sensitive electronic equipment, such as in clean rooms. Such mats are often treated or manufactured to have static-reducIng properties in order to reduce static charges which build up on persons or objects. The static-reducing surface covering material is electrically conductive and is antistatic in the sense that it reduces static and prevents the generation of a substantially instantaneous spark discharge, and yet is sufficiently electrically resistant so as not to be wholly electrically conductive and to control the discharge of accumulated static.

One electrically conductive web for discharging static electricity is described in U.S. Pat. No. 4,208,696. The electrically conductive web material for discharging static electricity includes a semiconductive, thermoplastic polymeric layer in contact with a foraminous layer, such as of foam or scrim, coated with a carbon-loaded, resinous material to impart a resistivity of between $10^3$ ohms and $10^7$ ohms. U.S. Pat. No. 4,525,398 discloses a thin layer of metallic foil bonded to a hard layer of plastic material by way of an electrically conductive adhesive material and a layer of backing material secured to the metallic foil. U.S. Pat. No. 4,363,071 relates to a static dissipative mat with a conductive inner layer of low surface resistance. The inner conductive layer comprises a thin film containing an electrically conductive ingredient, such as carbon black having a low surface resistivity. U.S. Pat. No. 4,472,471 concerns a hard, transparent, chair mat having a carbon-loaded, electrically conductive printing in grid disposed on the transparent plastic, while U.S. Pat. No. 4,590,120 also relates to a transparent, static-reducing chair mat containing a plurality of thin, conductive, invisible fibers forming a static-charge-draining, conductive layer within the mat, such as stainless steel fibers, between the upper and lower layers.

It is therefore desirable to provide a static-reducing, plastic surface covering material which effectively controls static without excessive electric conductivity, is dimensionally stable and resists delamination and which surface covering is easily manufactured at low cost.

SUMMARY OF THE INVENTION

The invention relates to a static-reducing surface covering material, to a method of its preparation and use and to the tissue material employed in the covering material. In particular, the invention concerns a static-reducing surface mat which contains an electrically conductive layer of metallized-coated tissue sheet material to provide static dissipative properties and dimensional stability to the mat.

The present invention concerns a static dissipative or static-reducing plastic surface covering material, such as a mat or runner-type material, which comprises a thermoplastic polymer layer, such as composed of a vinyl halide resin, like polyvinyl chloride, having a face surface and a back surface and a layer of an electrically conductive, metallized-coated, open-type, fibrous sheet material in an electrically conductive relationship with the polymer layer disposed and embedded securely within the thermoplastic layer to provide a static dissipative surface covering material. The invention also comprises a method of preparing a static dissipative or static-reducing surface covering, which method comprises securing or embedding an electrically conductive, metallized-coated, open, fibrous sheet material to or within a thermoplastic polymer layer. In use, the metallized, fibrous sheet material is secured by a grounding connection means to ground whereby static charges building up on persons or objects on the surface coating are discharged in a safe manner from such persons or objects and through the static-reducing surface covering to the ground connection to ground. The surface covering is particularly useful where the surface resistance of the surface covering is typically less than $10^{10}$ ohms, for example, $10^5$ to $10^8$ ohms/sq. Optionally, the volume resistivity (ohm-cm) is also within such ranges thereby providing a surface covering which reduces static charge safely without excess conductivity or quickly shorting out to ground which might damage electronic components or shock personnel.

The static dissipative surface covering material may vary in thickness, but generally ranges from about as low as, for example, 50 to 300 mils, such as, for example 70 to 150 to 200 mils in thickness. The electrically conductive, metallized-coated, open fibrous sheet material may also be selected and used to provide dimensional stability to the surface covering material when embedded in the material or in combinatio with other sheet material, and therefore, to control shrinkage and to make die cutting of the material easier. The electrical properties of the static dissipative surface coating material may vary depending for example upon variations in the compounding of the thermoplastic resins and the additives employed. The surface covering material may be employed as a floor or table mat, or a floor runner, and may be employed, for example, in those areas where shock-absorbing and cushioning are desired together with static dissipative properties, such as a tool box pad, and particularly for use in the electronic industry where reduction of static charges is of considerable importance to prevent damage to sensitive electronic components.

The thermoplastic layer of the surface covering material may comprise a rigid or typically a flexible thermoplastic polymeric material which may be transparent, translucent or a colored layer. A typical thermoplastic polymer layer suitable for use would include, but not be limited to thermoplastic urethane polymers, and more particularly, vinyl halide resins, such as polymers and copolymers of vinyl chloride and even more particularly, polyvinyl chloride. The thermoplastic layer may be prepared by extrusion or casting a number of layers, one on top of the other, employing a thermoplastic polymer, such as a vinyl plastisol or organosol. The thermoplastic layer typically comprises a face surface, which may or may not be an embossed or fibrous surface, e.g. a carpet tile, and a back surface. The layers may be composed of a solid polymer or a foam polymer or a combination of a one top layer of a solid polymer and one or more lower layers of a foam polymer of varying thickness as desired to provide the necessary shock-absorbing and cushioning properties. Where the thermoplastic layer comprises one or more foam layers, such as a vinyl foam layer, the foam layer generally has a range of from about 15 to 50 pounds per cubic foot.

The thermoplastic polymer may be compounded with various additives generally used to impart various properties to the thermoplastic layer, such as, for example, fillers, fibers, pigments, antioxidants, dyes, coloring agents, plasticizers, stabilizers, flame retardants, chemical blowing agents, diluents, cell control agents, activators, viscosity index improvers, as well as antistatic agents, such as carbon black particles. In plastisols, carbon back particles are only employed in limited quantity due to the increase in viscosity of the plastisol by such carbon black particles. More particularly, the polymer may contain electrically conductive amounts of other antistatic agents, such as a polyalkylene glycol, such as polyethylene and polypropylene glycols, quaternary ammonium compounds, particularly alkyl and benzyl quaternary ammonium halides, as well as long chain fatty acids and fatty esters and half esters of polyols. The amount of such additives, for example, may vary from 0.5 to 15 parts, for example, 1 to 10 parts per 100 parts of the thermoplastic polymer. The face surface of the thermoplastic layer optionally may be embossed or so treated to provide an antifriction, wear resistant or decorative surface, such as, for example, by passing the thermoplastic layer under or between rollers under heat and pressure to impart a desired embossing on the face surface or casting on an embossed release paper. The metallized-coated tissue sheet material may be used in the backing layer of fibrous carpet material, such as vinyl resin and bitumen-backed carpet tiles, for static dissipative purposes.

The static dissipative surface covering material includes therein or secured to one surface thereon, one or more electrically conductive, metallized-coated, organic or inorganic, woven or nonwoven, fibrous sheet materials to impart the desired electrical rsistivity and conductivity properties to the material. In one embodiment, the electrically conductive fibrous sheet material is employed or embedded within the layer of the thermoplastic material so as to also provide dimensional stability to the thermoplastic layer, such as, for example, to prevent shrinkage or curling of the surface covering material. Optionally, if desired, other dimensionally stabilizing sheet materials of an electrically conductive or a nonelectrically conductive nature may be employed with the metallized, fibrous, electrically conductive sheet material, such as, for example, polymeric woven or nonwoven material composed of nylon, polyester or combination thereof embedded within the thermoplastic layer or secured to the back surface of the thermoplastic layer.

The electrically conductive, metallized-coated, open, fibrous sheet material employed in the static dissipative surface covering is an open, translucent, fibrous sheet material in which one or both sides of the fibers have been coated with a thin, electrically conductive metal coating, like aluminum, such as applied in a vacuum deposition process. The fibrous material may comprise a wide variety of fibrous materials which may be metallized and which include, but are not limited to: natural and polymeric and organic and inorganic fibers and combinations thereof, and more typically, may comprise nylon, polypropylene; polyester; and generally preferred, glass fibers. While woven or scrim-like fibrous materials may be employed, such materials often do not impart a desired degree of dimensional stability and further, unless the open spaces or the fibers are close together, they do not impart enough interpoint electrical conductivity in comparison to the employment of nonwoven, randomly-oriented, fibrous sheet material, hereafter referred to as tissue sheet material.

In one embodiment of the invention, the electrically conductive, metallized-coated sheet material comprises a thin, bonded, nonwoven fiberglass mat composed of fiberglass monofilaments wich are oriented in a random pattern and bonded together with a resinous binder, such as of a thermosetting resin, like a urea-formaldehyde resin. For example, an aluminized-coated, glass fiber, open, nonwoven, randomly-oriented tissue sheet material for use in the static dissipative surface covering material may be prepared by placing a glass fiber, nonwoven tissue sheet material within a vacuum chamber and heating an aluminum source so that the glass fibers are coated on one or both sides with a thin, typically monomolecular, layer of vacuum-deposited, conductive aluminum or other metal ions and ion sputtered or applied onto the fiber surface.

The preferred tissue material to be employed has a nonwoven, randomly-oriented pattern and typically has a thickness ranging from about 2 to 20 mils, the glass fibers coated on one side with an aluminum coating by vacuum deposition and when the open spaces are random and constitute, for example, greater than 20%, for example, up to 50%, e.g. 30% to 45% of the surface area of the tissue material. The aluminized-coated, glass fiber tissue materia provides excellent electrical conductivity, but does not have too much electrical conductivity when the surface covering material is grounded to provide excess conductivity, that is, to give direct shorts, yet is sufficient to provide for reduction in electrical volume rsistivity in the narrow window range of $10^5$ to $10^8$ ohm-cm.

The aluminized-coated, glass fiber tissue material provides a surface resistivity when tested on a point-to-point contact using five pound electrodes connected to a megohm meter with the electrodes spaced apart at defined distances of say five, ten and fifteen inches of a range of about 200 to 1500 ohms, for example, of about 200 ohms at five inches apart and of about 400 to 500 ohms at fifteen inches apart. The aluminized-coated glass fiber tissue material, due to the openness of the tissue material, requires fairly large areas of contact in order to provide the best practical conductivity results. For example, when the one side-coated, aluminized tissue sheet material is incorporated into a vinyl chloride static dissipative mat and grounded on a stainless steel table, it provides an static dissipative mat which does not short out into the table. The openness of the tissue material is a desirable feature in that it permits the penetration or wetting of the vinyl plastisol or organosol material employed when the tissue sheet material is placed on the top surface of a plastisol layer and therefore provides an excellent bond and good lamination properties to the resulting mat product.

There are a number of techniques to prepare a static dissipative surface covering material containing a metallized tissue sheet material. For example, the metallized tissue material may be placed between hot, coextruded, polymeric layers or may be positioned within the thermoplastic layers, such as by permitting the tissue sheet material to penetrate a liquid foamable or nonfoamable plastisol or organosol layer of polyvinyl chloride resin to the desired location before heating to gel the layer. In another technique, the tissue material may be positioned by laminating two viny resin layers or a liquid foamable or nonfoamable plastisol layer to a vinyl foam layer with the metallized sheet material therebetween.

One method comprises forming a first layer of a liquid vinyl plastisol composition by casting, for example, 20 to 80 ounces per square yard of the plastisol, onto a support surface, such as a releasable paper sheet, e.g. an embossed surface release paper, a fluorocarbon-coated fiberglass or a stainless steel endless belt. The metallized-coated, fibrous tissue sheet material is then placed onto the top surface of the wet plastisol layer permitting the tissue sheet material to be penetrated and wetted by the plastisol or the plastisol layer gelled to the tissue sheet material placed on the gelled surface. The first plastisol then may be heated to gel the layer or the top surface thereof to control the position of the tissue sheet material. Thereafter, a second layer of a foamable or nonfoamable liquid vinyl resin plastisol, for example, at 20 to 100 ounces per square yard, which may be the same or of different density than the first layer, is then cast over the fibrous tissue sheet material on the first gelled layer. Thereafter, the first and second layers containing the metallized tissue sheet material may be heated, generally in a hot air oven or by heated platens, to gel and fuse the first and second layers, and where desired, to expand the layers to create foam layers or to form a solid, fused carbon bottom layer with face and back surfaces with the metallized-coated glass fiber tissue material thereafter embedded in a defined position to the face surface of the static dissipative surface covering material. Optionally thereafter, the face surface may be embossed.

The invention will be described for the purposes of illustration only in connection with one or more particular embodiments. However, it is recognized that various changes, modifications, improvements and additions may be made to the invention as illustrated all falling within the spirit and scope of the invention as described and claimed.

DESCRIPTION OF THE EMBODIMENTS

Figure 1:
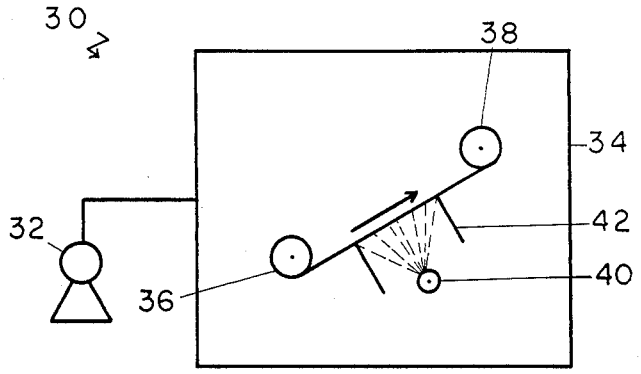
FIG. 1 is a schematic illustration of one method of preparing a metallized-coated tissue sheet material.

FIG. 1 is a schematic illustration of a method of preparing an aluminized tissue sheet material 10, useful in the static dissipative surface covering material, and shows a system 30 with a vacuum pump 32 connected to a vacuum deposition chamber 34 containing therein a source of aluminum 40 with shields 42 and a roll of glass fiber 36, for example, Johns-Manville Dura-Glass TM Mats, to provide a fiberglass tissue material which moves in front of and past the guards 42 and is subject to be vacuum-deposited of the aluminum on one side thereof with the aluminized tissue material rolled up in roll 38. If desired, due to the openness of the nonwoven tissue sheet material, aluminizing, or the use of other metals, of the one side permits aluminum ions to pass through the open part of the material and be deposited onto the chamber walls 34. Therefore, it may be desirable to provide the glass fiber tissue 36 on a release or other paper sheet, and thereafter strip the aluminized fiberglass tissue material from the paper sheet. In addition, as illustrated, the aluminized glass fiber is coated on one side only, and where desired, the roll 38 may be replaced in the position of roll 36 and the other side also aluminized.

Figure 2:
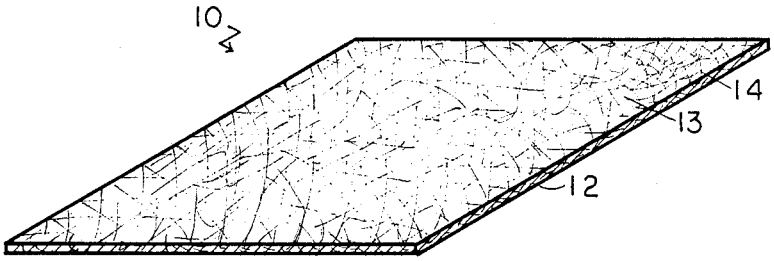
FIG. 2 is a perspective view of a metallized-coated, open, fibrous tissue sheet material employed in the invention and prepared as in FIG. 1.

FIG. 2 shows a metallized, that is, aluminum-coated, nonwoven, glass fiber, open tissue sheet material 10 comprising nonwoven, randomly disposed, glass monofilaments 12 secured together with a resinous binder wherein the one side of the tissue sheet material 10 has been coated with a monomolecular layer of vacuum-deposited aluminum 14 with open area 13 as in FIG. 1.

Figure 3:
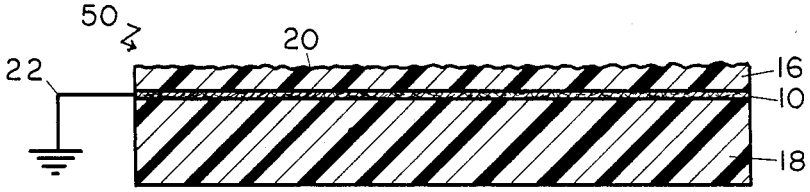
FIG. 3 is an enlarged, fragmentary, sectional view of an static dissipative surface covering material employing the tissue sheet material of FIG. 2.

FIG. 3 is an enlarged, fragmentary view of a solid mat 50 having a thickness of 60 to 130 mils and wherein the metallized tissue sheet material 10 is shown embedded in the mat 50 in a position about 30 to 40 mils from the embossed face surface 20 with the top layer 16 comprising a solid vinyl chloride resin and the bottom layer 18 comprising a solid vinyl chloride resin and with a ground connection 22 in the material 50, such as a clip or a grommet, and secured to the tissue sheet material 10 with a ground wire leading from the embedded tissue sheet material 10 to ground.

The static dissipative surface covering material of the invention provides for an effective reduction in static without excessive grounding and also provides for a surface covering which has dimensional stability, low cost and which is easily manufactured.

What is claimed is:

1. A static dissipative, dimensionally stable dissipative surface covering material, such as a floor or table mat, which comprises:

(a) a flexible thermoplastic polymer layer of sufficient thickness to act as a floor or table mat and having a face surface and a back surface;

(b) a layer of an electrically conductive, vacuum deposited, metallized coated, open, nonwoven, resin bonded, fibrous sheet material bonded to or embedded within the thermoplastic polymer layer to provide a static dissipative surface covering material, and wherein the surface and volume resistance of the surface covering material ranges from about $10^5$ to $10^8$ ohm or ohm/cm respectively and the said surface covering material lies flat; and (c) an electrical grounding means to connect the fibrous sheet material to ground.

2. The material of claim 1 wherein the thermoplastic polymer comprises a vinyl chloride polymer.

3. The material claim 1 wherein the thermoplastic polymer comprises a first layer, one surface of which forms the face surface and which is composed of a solid thermoplastic polymer and a second layer which forms the back surface and which second layer is a foam layer.

4. The material of claim 1 wherein the thermoplastic polymer layer includes a static dissipative amount of a static-reducing additive agent therein.

5. The material of claim 1 wherein the fibrous sheet material comprises a metallized-coated, glass fiber material.

6. The material of claim 5 wherein the fibrous sheet material comprises a nonwoven, randomly-oriented glass fiber bound together by a resinous material.

7. The material of claim 1 wherein the metallized coated fibrous sheet material comprises an aluminized coat.

8. The material of claim 7 wherein the metallized coated fibrous sheet material comprises a monomolecular layer of a vacuum-deposited aluminum coating on one or both sides of the fibrous sheet material.

9. The material of claim 1 wherein the fibrous sheet material has an open surface area of from about 20% to 50% of the surface area.

10. The material of claim 1 wherein the fibrous sheet material is embedded within the thermoplastic polymer layer.

11. The material of claim 1 wherein the fibrous sheet material comprises an open, nonwoven, randomly-oriented, resin-bonded, aluminized-coated, glass fiber tissue sheet material.

12. The material of claim 14 wherein the tissue sheet material has a point-to-point resistance of about 200 to 1500 ohms for five to fifteen inches.

13. A static dissipative or static-reducing surface covering material which comprises:

(a) a first vinyl chloride polymer layer having a face surface;

(b) a second vinyl chloride polymer layer having a back surface;

(c) a layer of electrically conductive, vacuum deposited, aluminized-coated, open, nonwoven, resin bonded, glass fiber tissue sheet material disposed between the first and second polymer layers; and (d) a grounding means to connect the aluminized-coated tissue material to ground.

14. The material of claim 13 wherein the first vinyl chloride layer comprises a solid vinyl chloride layer, and the second layer is a foam layer.

15. The material of claim 1 having a thickness of from about 50 to 300 mils to provide cushioning and shock-absorbing properties to the material.

* * * * *